US011359341B2

(12) United States Patent
Demaria et al.

(10) Patent No.: US 11,359,341 B2
(45) Date of Patent: Jun. 14, 2022

(54) BOLLARD DEVICE

(71) Applicant: FAAC S.P.A., Zola Predosa (IT)

(72) Inventors: Riccardo Demaria, Sala Bolognese (IT); Samuele Magnoni, Bologna (IT)

(73) Assignee: FAAC S.P.A., Zola Predosa (IT)

( * ) Notice: Subject to any disclaimer, the term of this patent is extended or adjusted under 35 U.S.C. 154(b) by 0 days.

(21) Appl. No.: 16/901,835

(22) Filed: Jun. 15, 2020

(65) Prior Publication Data

US 2020/0392681 A1 Dec. 17, 2020

(30) Foreign Application Priority Data

Jun. 17, 2019 (IT) ..... 102019000009141

(51) Int. Cl.
*E01F 13/04* (2006.01)

(52) U.S. Cl.
CPC ..... *E01F 13/046* (2013.01)

(58) Field of Classification Search
CPC ..... E01F 13/026; E01F 13/04; E01F 13/042; E01F 13/044; E01F 13/046
See application file for complete search history.

(56) References Cited

U.S. PATENT DOCUMENTS

D470,598 S * 2/2003 Schneider ..... D25/126
7,717,641 B2 * 5/2010 Stice ..... E01F 13/046 404/73
8,096,727 B2 * 1/2012 Parenti ..... E01F 13/046 404/6
8,607,488 B2 * 12/2013 Johnston ..... G09F 15/0075 40/612
8,684,571 B1 * 4/2014 Alaura ..... F21V 29/77 362/431
9,127,423 B2 * 9/2015 Ball ..... E01F 13/123
9,328,470 B2 * 5/2016 Berto ..... F21V 33/0076
(Continued)

FOREIGN PATENT DOCUMENTS

EP 3431663 A1 1/2019
GB 2489516 A 10/2012
(Continued)

OTHER PUBLICATIONS

Search Report for Italian Application No. 102019000009141 dated Feb. 6, 2020.

*Primary Examiner* — Gary S Hartmann
(74) *Attorney, Agent, or Firm* — Pearne & Gordon LLP

(57) ABSTRACT

A bollard device including a frame insertable in a horizontal plane. A base plate is disposed on the frame and has a hole. A movable part is received within the hole and moves vertically between a retracted position, wherein an upper end thereof is flush with the base plate, and an extended position wherein the upper end of the movable part extends beyond the base plate to create an obstacle. The frame includes a plurality of metallic supports defining an underground housing for the movable part and guides by which the movable part slides vertically. Actuating element is housed either in the frame or in the movable part and is configured to permit the vertical movement of the movable part. The movable part includes a stem and a protective tubular member disposed on the stem and constrained thereon by removable coupling element permitting the protective tubular member to be removed.

9 Claims, 2 Drawing Sheets

(56) References Cited

U.S. PATENT DOCUMENTS

| | | | | |
|---|---|---|---|---|
| 10,385,528 | B2 * | 8/2019 | Heald | E01F 9/646 |
| 2014/0147201 | A1 | 5/2014 | Ball | |
| 2015/0050084 | A1 | 2/2015 | Berto | |
| 2016/0117959 | A1 * | 4/2016 | Walters | G09F 19/22 404/6 |
| 2018/0245296 | A1 | 8/2018 | Heald | |
| 2020/0173190 | A1 * | 6/2020 | Galla | E04H 17/266 |

FOREIGN PATENT DOCUMENTS

| | | | |
|---|---|---|---|
| GB | 2541654 | A | 3/2017 |
| IT | MI20100759 | A1 | 10/2011 |
| WO | 20130140338 | A1 | 9/2013 |

* cited by examiner

BOLLARD DEVICE

CROSS-REFERENCE TO RELATED APPLICATIONS

This application claims the benefit of Italian Application No. 102019000009141, filed Jun. 17, 2019, the entire disclosure of which is hereby incorporated herein by reference.

FIELD OF THE INVENTION

The present invention relates to urban decor and in particular to those device that are called bollard devices, designed to prevent or regulate access to zones limited to vehicle traffic, such as pedestrian zones limited traffic zones (ZTL), etc.

BACKGROUND OF THE INVENTION

Devices of this type which selectively prohibit a vehicle (bicycle, motorbike, car, . . . ) from accessing limited traffic zones, such as pedestrian zones, private car parks, private parks, residential buildings, etc. are known.

Said devices are generally equipped with an internal clock that allows them to pass from a state retracted in the ground to a state in which they rise and form a barrier that limits the access to the controlled zone.

They are often arranged on roadways and disappear into the ground when access is allowed.

The traffic bollards sold to date on the market generally have a movable part or stem, usually cylindrical, constrained to slide vertically, moved by a special actuator. The actuator can be of hydraulic, electromechanical or other type; it can be housed either in the fixed part or in the movable part of the bollard. The fixed part of the bollard comprises a frame, the upper face of which is flush with the ground which is housed in underground wells below the walking surface.

The cylindrical body or stem is sometimes equipped with a small stripe of reflective tape or LED to be visible at night.

The movable part of the bollard slides vertically supported by a guide integral with the fixed part of the same.

These stems can also have audio equipment, for signalling them to blind people, or be customised with the name or logo of their owner.

The applicant has noted that a bollard is always subject to the action of the environment in which it is installed. The presence of gravel, sand, stones, water, salt, hydrocarbons can compromise the functionality of the bollard, particularly in relation to the sliding of the stem, or more simply, even without compromising its functionality, it can damage the aesthetic appearance of the same. Furthermore, the bollard can be damaged by the ordinary action of road users or by vandalism. In particular, the presence of scratches, marks or corroded areas on the external surface of the movable cylinder of the bollard is frequent. If replacement of the movable part is necessary, the operation requires expensive interventions and maneuvers to lift the damaged cylinder and position the new cylinder. This activity can only be carried out with the help of lifting machines, since the weight of the steel cylinder can even reach 500 kg.

BRIEF SUMMARY OF THE INVENTION

The object of the present invention is to provide a bollard device which obviates the above mentioned drawbacks.

An aspect of the present invention relates to a bollard device having the characteristics of the enclosed claim 1.

BRIEF DESCRIPTION OF THE DRAWINGS

Other characteristics and advantages of the invention will be described below with reference to an embodiment of the invention itself illustrated in the attached figures which illustrate in particular.

DESCRIPTION OF EXAMPLE EMBODIMENTS

Figure 1:
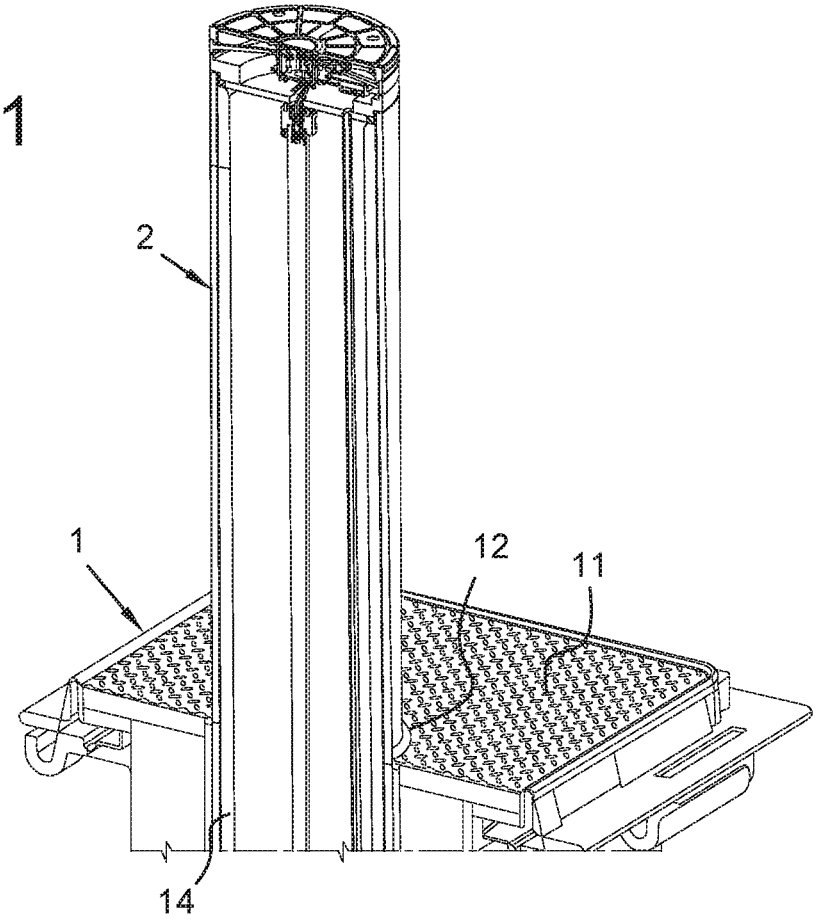
FIG. 1 is a perspective view of the bollard device according to the invention, sectioned along a diameter of the stem which is in an extended position.
Figure 2:
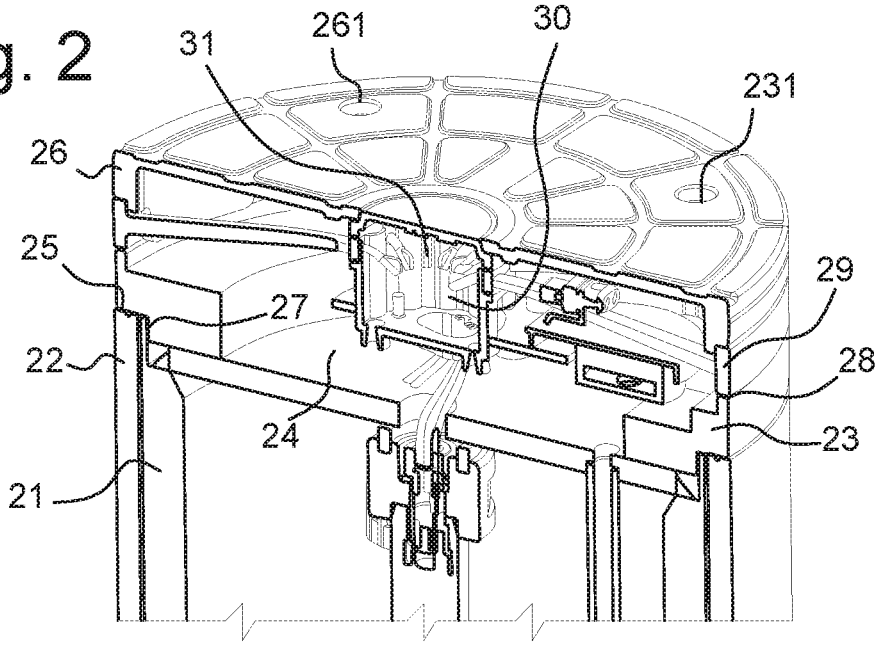
FIG. 2 is an enlarged detail of the upper portion of the bollard of FIG. 1.
Figure 3:
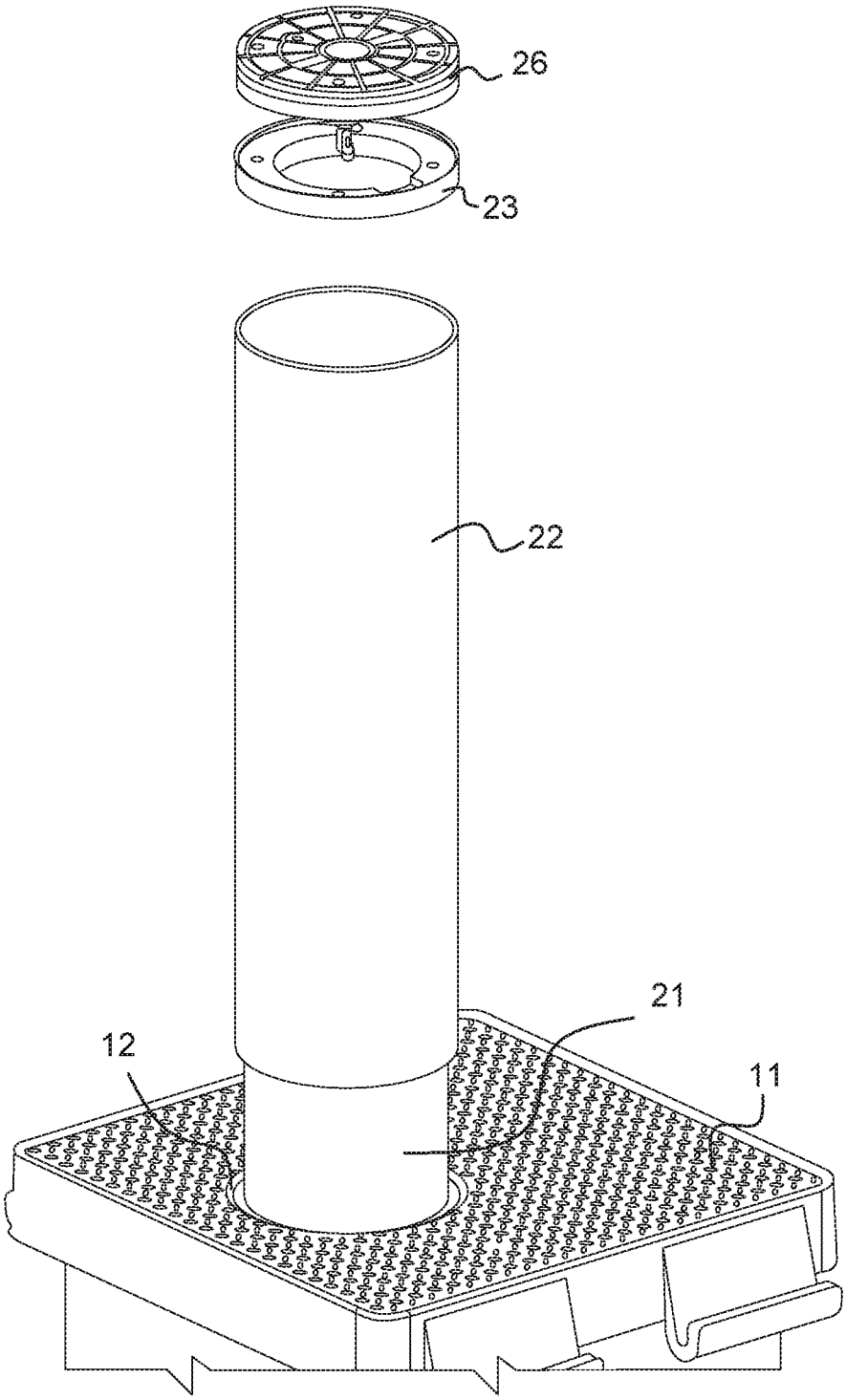
FIG. 3 is an exploded perspective view of the device according to FIG. 1; perspective of the stem of the bollard of FIG. 1.

With reference to the aforementioned figures, the bollard device of the invention comprises a fixed part or frame 1, preferably of a substantially rectangular shape which is inserted inside the ground, or in general of a horizontal plane, for example a road surface. A base plate 11 with a hole 12 is added to the frame 1, from which a movable part 21 can slidably exit, preferably cylindrical in shape, that can take a retracted position, wherein the upper end is flush with said base plate and a projecting or extended position wherein the movable part extends beyond the plate 11 to create an obstacle, The frame comprises a plurality of metal supports determining the realization of an underground housing for the movable part and guides 13 by which it slides vertically.

Actuating means 14, for example electric or hydraulic actuators, or any type, can be housed either in the fixed part or in the movable part of the bollard device thus permitting the vertical movement.

According to the present invention, the movable part comprises a stem 21 and a coating 22, preferably tubular, put on said stem and constrained to the same by removable coupling means permitting to the coating to be removed. Said coupling means are provided on the top of the stem and substantially comprise a shaped ring 23 that is associated both to the top 24 of the stem 21 and to the upper edge 25 of the coating 22 and a cover 26 closing from the above the stem constrained by the ring and the coating.

Preferably, the cover 26 is constrained to the ring 23 and to the stem by coupling means, such as for example screws, inserting through holes 261 and 231 provided on the cover and on the ring and screw in seats (not shown) realized on the top 24 of the stem. Alternatively, the cover and the ring are fixed on the top of the stem by means of interlocking means.

The ring comprises a lower shoulder 27 permitting to the ring base to rest on the top of the stem and at the same time resting its lower edge on the upper edge 25 of the coating. Said ring also comprises an upper edge 28 associating to a lower edge 29 of the cover.

The cover 26 contains the housing 30 and the power cables for lighting the bollard.

Preferably, the tubular coating is made of plastic material, for example in polyurethane.

For example, a polyurethane with a global density ranging between 100 and 2000 kg/m$^3$ and a hardness between 10 and 200 Shore D is used.

A metallic sheet (e.g. stainless steel) can be overprinted on the coating 22. In this way it is possible to obtain particular surface finishes, without changing the structure of the bollard.

The introduction of the external protective coating according to the present invention entails the following technical advantages.

Protection of the movable part of the bollard is guaranteed, as it is no longer possible to damage the surface of the cylinder by scratches or marks. Moreover, in the case of generation of corrosive phenomena, the same would be masked by the presence of the protection ring.

The coating allows the possibility to aesthetically customise the movable part, the user can choose the colour of the coating or overprint writings and advertisements.

The possibility of overprinting a metallic sheet to the external protection coating allows to obtain particular surface finishes, without changing the structure of the bollard.

In the event of damage or wear, the external coating can be easily replaced by releasing it from the stem by means of the coupling means. This operation can be carried out manually, without the aid of lifting machines, since it does not involve the removal of the stem which is usually made of metal, for example steel.

The invention claimed is:

1. A bollard device comprising:

a frame insertable in a horizontal plane;

a base plate disposed on the frame, the base plate having a hole;

a movable part received within the hole, the movable part being configured to move vertically between a retracted position, wherein an upper end thereof is flush with said base plate, and an extended position wherein the upper end of the movable part extends beyond the base plate to create an obstacle; and actuating means housed either in the frame or in the movable part, the actuating means being configured to permit the vertical movement of the movable part, said frame comprising a plurality of metallic supports defining an underground housing for the movable part and guides by which the movable part slides vertically, wherein the movable part comprises a stem and a protective tubular member disposed on said stem and constrained thereon by removable coupling means permitting said protective tubular member to be removed, wherein a coupling ring is provided on a top of the stem and at an upper edge of the protective tubular member, wherein a cover closes from above the stem constrained by the coupling ring and the protective tubular member, and wherein the cover is constrained to the coupling ring and to the stem by coupling members inserted through corresponding through-holes provided in each of the cover and the coupling ring, and which engage with corresponding screw in seats on the top of the stem.

2. The bollard device according to claim 1, wherein said protective tubular member is comprised of plastic material.

3. The bollard device according to claim 1, wherein said protective tubular member is comprised of polyurethane.

4. The bollard device according to claim 1, wherein both the stem and the protective tubular member have a cylindrical shape.

5. The bollard device according to claim 1, wherein the cover and the coupling ring are fixed on the top of the stem by interlocking means.

6. The bollard device according to claim 1, wherein the coupling ring comprises a lower shoulder permitting a ring base of the coupling ring to rest on the top of the stem and permitting a lower edge thereof to rest on the upper edge of the protective tubular member.

7. The bollard device according to claim 1, wherein said coupling ring comprises an upper edge disposed adjacent a lower edge of the cover.

8. The bollard device according to claim 1, wherein the protective tubular member is comprised of a polyurethane having a total density ranging between 100 e 2000 kg/m$^3$ and hardness ranging between 10 e 200 Shore D.

9. The bollard device according to claim 1, wherein a metallic sheet is overprinted on the protective tubular member.

* * * * *